United States Patent [19]

Ohie

[11] 4,439,116

[45] Mar. 27, 1984

[54] FUEL INJECTION PUMP

[75] Inventor: Tomonori Ohie, Higashimatsuyama, Japan

[73] Assignee: Diesel Kiki Co., Ltd., Tokyo, Japan

[21] Appl. No.: 350,463

[22] Filed: Feb. 19, 1982

[30] Foreign Application Priority Data

Mar. 4, 1981 [JP] Japan ..... 56-29047[U]

[51] Int. Cl.[3] ..... F02M 59/24

[52] U.S. Cl. ..... 417/499; 123/500

[58] Field of Search ..... 417/494, 499; 123/446, 123/500, 501, 503

[56] References Cited

U.S. PATENT DOCUMENTS

| | | | |
|---|---|---|---|
| 2,147,390 | 2/1939 | Vaudet | 123/500 |
| 2,174,526 | 10/1939 | Parker | 417/499 X |
| 2,187,732 | 1/1940 | De Juhasz | 417/494 |
| 3,771,917 | 11/1973 | Davies | 417/499 X |

FOREIGN PATENT DOCUMENTS

| | | | |
|---|---|---|---|
| 758184 | 1/1934 | France | 123/501 |
| 833992 | 11/1938 | France | 417/494 |
| 1044494 | 11/1953 | France | 417/494 |
| 402886 | 12/1933 | United Kingdom | 123/501 |
| 715373 | 9/1954 | United Kingdom | 417/494 |
| 1439934 | 6/1976 | United Kingdom | 417/499 |

*Primary Examiner*—Leonard E. Smith

*Attorney, Agent, or Firm*—James Creighton Wray

[57] ABSTRACT

In a fuel injection pump having a dual plunger composed of a first plunger for adjusting the timing of the beginning of fuel injection and a second plunger for adjusting the timing of the end of fuel injection, the first and second plungers are operatively connected with a governor in such a way that only the first adjusting member is operated in accordance with the governor and the second plunger is displaced in accordance with the displacement of the first plunger, whereby the second plunger is displaced by the distance necessary for compensating for the change in the amount of fuel injection caused by the displacement.

8 Claims, 10 Drawing Figures

FUEL INJECTION PUMP

FUEL INJECTION PUMP The present invention relates to a fuel injection pump for an internal combustion engine in which the timing of the beginning of fuel injection can be set independently of the setting of the timing of the end of fuel injection.

Recent circumstances such as the increase in the cost of fuel has led to the frequent use of lower quality fuels in marine engines. Moreover, fuel quality varies considerably with port of call. Therefore, to obtain good combustion of such low quality fuels in the cylinder of the engine, it is desirable to change the timing of the beginning of fuel injection each time there is a change in the quality of the fuel. That is, it is desirable always to operate the injection pump at the timing of the beginning of the fuel injection which is optimum for the quality of the supplied fuel.

In order to satisfy this desire, there has been widely used a separate type fuel injection pump which has a plunger for adjusting the timing of the beginning of fuel injection independently of a plunger for adjusting the amount of fuel injected and each plunger is operated by its own adjusting rack. However, in this conventional fuel injection pump, when the adjusting rack for adjusting the timing of the beginning of fuel injection is positioned so as to increase the injection advance, if the adjusted condition of the unger for adjusting the amount of fuel injected is not changed, it follows that the amount of fuel injected is increased substantially. As a result, to maintain the engine speed at a desired speed, the adjusting rack for adjusting the amount of fuel injected is displaced by a governor so as to decrease the amount of fuel injected. However, in a marine engine system, the load on the engine is judged from the position of the adjusting rack for adjusting the amount of fuel injected. Therefore, if the position of the adjusting rack for adjusting the amount of fuel injected is displaced in response to the positional adjustment of the rack for adjusting the timing of the beginning of fuel injection, the operator will no longer be able to judge the load on the engine accurately.

It is therefore an object of the present invention to provide an improved separate type injection pump for an internal combustion engine system.

It is another object of the present invention to provide an inproved separate type injection pump suitable for use in a marine diesel engine system.

It is a further object of the present invention to provide a separate type fuel injection pump wherein the correcting operation for the change in the amount of fuel injected caused by the adjustment of the injection advance can be carried out automatically.

It is a still further object of the present invention to provide a separate type fuel injection pump in which the change in the amount of fuel injected caused by the adjustment of the injection advance can be automatically corrected without causing displacement of the control rack of the governor.

According to the present invention, in a fuel injection pump having a first plunger with a first helix lead which serves to set the timing of the end of fuel injection, a second plunger with a second helix lead which serves to set the timing of the beginning of fuel injection, and a barrel which has ports corresponding to said first and second helix leads and receives the first and second plungers, a first pinion member is engaged with the first plunger so as to allow the first plunger to reciprocate in its axial direction but to move together with the first pinion member in its circumferential direction and a second pinion member is engaged with the second plunger so as to allow the second plunger to reciprocate in its axial direction but to move together with the second pinion member in its circumferential direction. The first pinion member is engaged with a first rack for adjusting the rotational position of the first plunger to set the timing of the end of fuel injection at any desired timing, and the second pinion member is engaged with a second rack for adjusting the rotational position of the second plunger to set the timing of the beginning of fuel injection at any desired timing. The fuel injection pump is provided with a governor having an operating rod for positioning the position of the first rack, and the operating rod and the first and second racks are operatively connected through a lever mechanism or a link mechanism. The lever mechanism functions such that only the first rack is displaced placed in accordance with the movement of the operating rod and only the first rack is displaced at a predetermined ratio of displacement in response to the displacement of the second rack. That is, in response to the displacement of the operating rod, the first rack is positioned without causing the second rack to move and in response to the displacement of the second rack, the first rack is displaced without causing the operating rod to move. As a result, the change in the amount of fuel injected caused by the displacement of the second rack can be compensated for without changing the position of the operating rod, so that the position of the operating rod always shows the exact amount of fuel injection. The above-mentioned compensating operation can be easily realized by selecting the ratio of displacement between the first and the second racks when the position of the second rack is adjusted, in relation to the configurations of the first and the second helix leads.

As described above, even when the timing of the beginning of the fuel injection is changed by the displacement of the second rack, the amount of fuel injected after the timing of the beginning of fuel injection has been changed can be maintained at the same amount as before the change, so long as the operating rod of the governor is maintained in the same position. As a result, the magnitude of the load on the engine can be known from the position of the operating rod irrespective of the position of the first rack.

Further objects and advantages of the invention will be clear from the following detailed description to be read in conjunction with the accompanying drawings in which.

Figure 1:
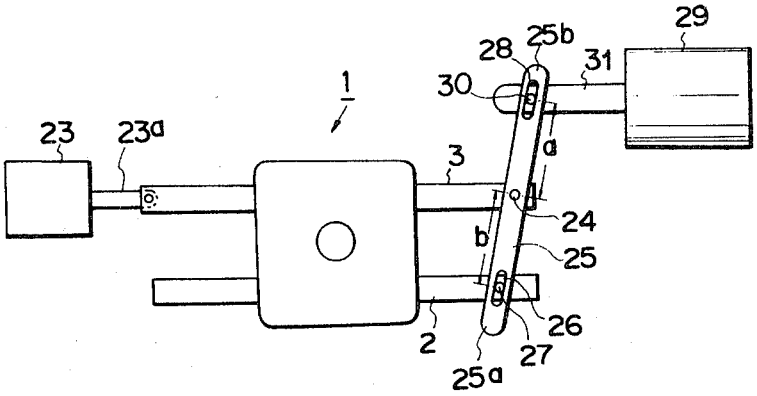
FIG. 1 is a plan view of one embodiment of the fuel injection pump of the present invention.

FIG. 1 illustrates an embodiment of the separate type fuel injection pump of the present invention. A fuel injection pump 1 is mounted on a marine diesel engine (not shown) and is driven by a cam secured to a drive shaft (not shown) in the diesel engine. The fuel injection pump 1 has a first rack 2 for adjusting the amount of fuel injected and a second rack 3 for adjusting the injection advance, and the amount of fuel injected and the injection advance are adjustable in accordance with the positions of the first and the second racks 2 and 3 in their axial directions.

Figure 2:
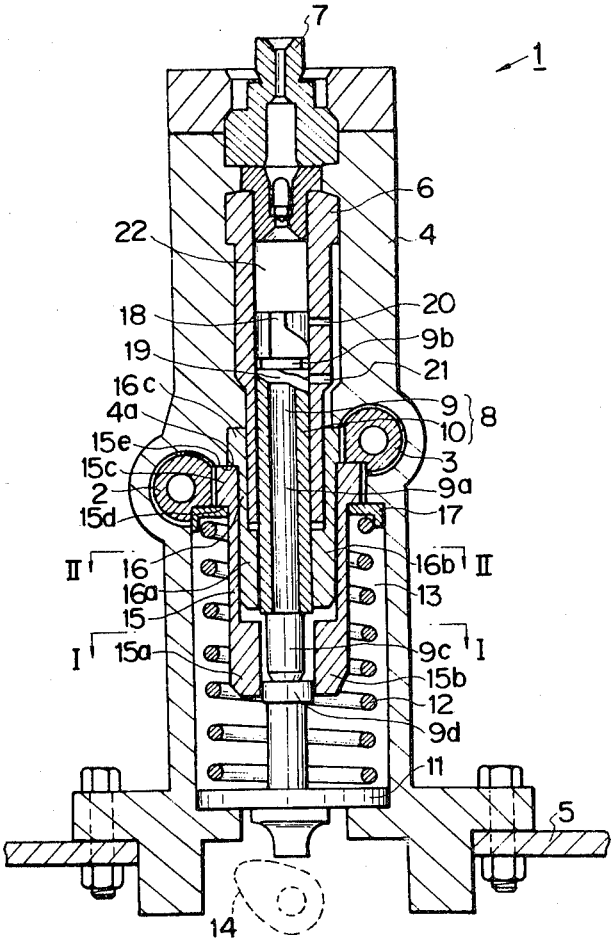
FIG. 2 is a longitudinal sectional view of the body of the fuel injection pump of FIG. 1.

Referring to FIG. 2, there is shown a cross sectional view of the fuel injection pump 1.

The fuel injection pump 1 has a casing 4 which is fixed to a housing 5 of the diesel engine by bolts. A plunger barrel 6 having, at one end thereof, a delivery valve 7 is disposed in the casing 4. A dual plunger 8 comprised of an inner plunger 9 for adjusting the timing of the end of fuel injection and an outer plunger 10 for adjusting the timing of the beginning of fuel injection (injection advance) is fitted in the plunger barrel 6 and a flange 11 formed at the lower end of the dual plunger 8 is biased downwardly by a compression spring 12 housed in a chamber 13 of the casing 4.

The outer plunger 10 is coaxially fitted on a small diameter portion 9*a* of the inner plunger 9 in such a way that the outer plunger 10 is prevented from moving relatively to the inner plunger 9 in the direction of its axis by enlarged portions 9*b* and 9*c* which are formed at upper and lower ends of the inner plunger 9, respectively. As a result, the inner plunger 9 and the outer plunger 10 can be rotated about their axes independently of each other but can only move integrally with each other in the axial direction. Therefore, in accordance with the rotation of a cam 14 in the diesel engine, these plungers 9 and 10 reciprocate in the axial direction at the same time.

On the outside of the dual plunger 8, there are coaxially provided a sleeve 15 for adjusting the rotational position of the inner plunger 9 and a sleeve 16 for adjusting the rotational position of the outer plunger 10.

Figure 3:
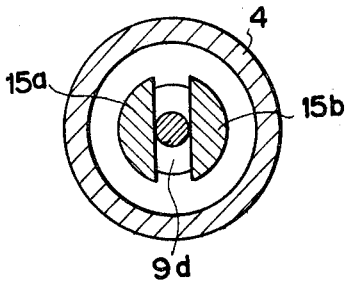
FIG. 3 is a horizontal sectional view of the body of the fuel injection pump of FIG. 2 taken along the line I—I.

A pair of legs 15*a* and 15*b* parallely spaced from each other are formed at the lower end of the sleeve 15, and a key 9*d* integrally formed with the inner plunger 9 at its lower end is fitted in the space formed between the legs 15*a* and 15*b* as shown in FIG. 3. As will be seen from FIGS. 2 and 3, the key 9*d* is inserted in this space so as to allow the key 9*d* to move upward or downward through the space, so that the sleeve 15 may rotate integrally with the inner plunger 9 but cannot restrict the movement of the inner plunger 9 in its axial direction. A pinion portion 15*c* is formed at the upper end portion of the sleeve 15 and is meshed with the first rack 2 inserted through the casing 4. A shim 17 receiving the force of the spring 12 is pressed onto a shoulder portion 15*d* of the pinion portion 15*c*, and the upper top surface 15*e* of the sleeve 15 is pressed onto the corresponding shoulder portion 4*a* formed in the casing 4. As a result, the sleeve 15 is axially positioned as shown in FIG. 2, whereas its rotational position (degree of rotation about its axis) varies in accordance with the movement of the first rack 2 in its axial direction. Therefore, the sleeve 15 can adjust the angular position of the inner plunger 9 in accordance with the axial movement of the first rack 2 without causing the inner plunger 9 to move along its axis.

Figure 4:
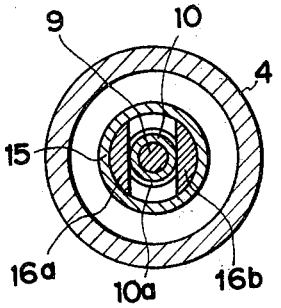
FIG. 4 is a horizontal sectional view of the body of the fuel injection pump of FIG. 2 taken along the line II—II.

The other sleeve 16 has a pair of spaced parallel legs 16*a* and 16*b* and a key 10*a* integrally formed with the outer plunger 10 is fitted between the legs 16*a* and 16*b* (FIG. 4). As a result, the sleeve 16 can rotate conjointly with the outer plunger 10 but cannot restrict the movement of the outer plunger 10 in the axial direction.

The sleeve 16 is fitted inside the sleeve 15 by which it is supported and a pinion portion 16*c* formed on the upper end portion of the sleeve 16 is meshed with the second rack 3. Thus, the angular position of the outer plunger 10 can be adjusted in accordance with the movement of the second rack 3 in its axial direction without restricting the movement of the outer plunger 10 in its axial direction.

On upper circumference surface of the plunger 9 is a helix lead 18 for regulating the timing of the end of fuel injection and on upper circumference surface of the plunger 10 is a helix lead 19 for regulating the timing of the beginning of fuel injection. These helix leads 18 and 19 serve to change these timings by cooperating with ports 20 and 21 defined in the barrel 6.

The port 20 is closed by the side wall of the inner plunger 9 and the port 21 is aligned with the helix lead 19 when the dual plunger 8 is in the lowermost position (the position of FIG. 2), so that the fuel is not pressurized in a high-pressure chamber 22 upon rising of the dual plunger 8. When the dual plunger 8 is further moved upwardly and the port 21 is closed by the side wall of the outer plunger 10, the fuel begins to be pressurized in the high-pressure chamber 22 and the pressurized fuel is fed to an associated injection pipe (not shown) through the delivery valve 7. When the dual plunger 8 is further moved upwardly and the port 20 is aligned with the helix lead 19, the injection of the fuel is completed. The timings at which the ports 20 and 21 are closed or opened can be easily adjusted as desired by adjusting the rotational positions of the plungers 9 and 10.

Returning to FIG. 1, the second rack 3 is pivotally connected at one end (the left end in the drawing) thereof to an operating rod 23*a* of an actuator 23 and the injection timing can be adjusted to any desired value by controlling the position of the second rack 3 by means of the actuator 23. On the other hand, at one end (the right end) of the first rack 2, there is provided a pin 27 which engages with an elongated hole 26 provided at one end (the lower end) 25*a* of a lever 25 which is pivotally supported by a pin 24 at the other end (the right end) of the second rack 3. Engagement of the pin 27 with the enlongated hole 26 links the right end of the first rack with the arm 25.

Figure 5:
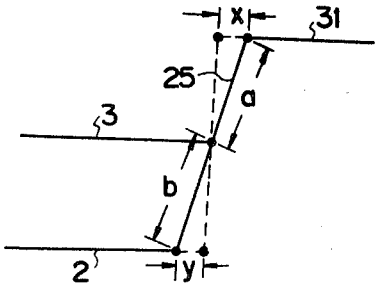
FIG. 5 and FIG. 6 are diagrammatic illustrations of the link mechanism shown in FIG. 1.

The other end (the upper end) 25*b* of the lever 25 is linked with an operating rod 31 of a governor 29 by the engagement of a pin 30 fixed to the operating rod 31 with an elongated hole 28 of the lever 25. Namely, the first rack 2 is linked with the governor 29 through a lever which is pivotally supported on the second rack 3. In the embodiment shown in FIG. 1, the distance between the pin 24 and pin 30 is defined as a and the distance between the pin 24 and the pin 27 is defined as b. Moreover, the racks 2 and 3 and the operating rod 31 are arranged in parallel. Accordingly, when the operating rod 31 of the governor 29 is moved by the distance x, the first rack 2 moves by the distance y ($=b/a \cdot x$) in the direction opposite to the movement of the operating rod 31. Assuming now that a=b, the ratio of x to y becomes 1. As a result, the first rack 2 will move by the amount of the movement of the operating rod 31 (see FIG. 5).

Figure 6:
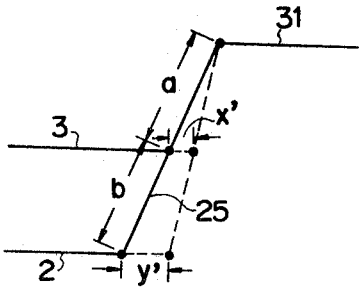

On the other hand, supposing a case where the second rack 3 is moved by the actuator 23 with no movement of the operating rod 31, the distance of movement x' of the second rack 3 and that of movement y' of the first rack 2 is still decided by the value of a/b, and in the case of a=b, it becomes x':Y'=1:2, as will be seen from FIG. 6.

Figure 7:
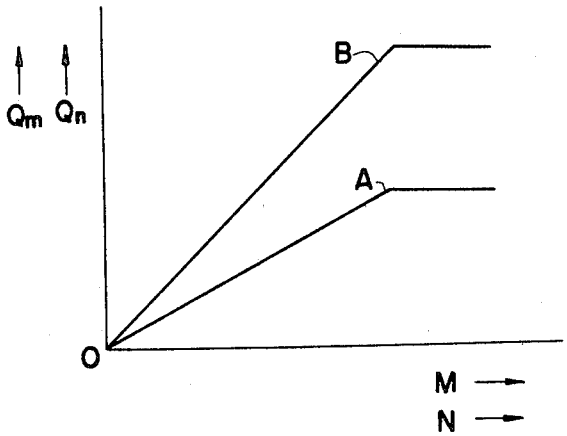
FIG. 7 is a graphical representation showing characteristic curves of the fuel injection pump of FIG. 1.

In FIG. 7 the curve A indicates the relationship between the amount M of movement of the first rack 2 and the increment Qm in the amount of fuel injection which is determined in accordance with the amount M, while the curve B indicates the relationship between the amount N of movement of the second rack 3 and the decrement Qn in the injection amount which is determined in accordance with the amount N. It will be appreciated from the curves that up to the time that the amount of movement M, N reaches a predetermined value the increment and the decrement in the amount of fuel injection changes in proportion to the amount of movement of the rack. That is, the relationships between M and Qm, and N and Qn are linear. In addition, the inclination of the curve B is set at just two times that of the curve A by selection of the configurations of the helix leads 18 and 19. Namely, in the characteristic curves shown in FIG. 7 when the second rack 3 is moved a predetermined distance $\alpha$, the first rack 21 moves $2\alpha$ in the same direction, the increase and decrease in the amount of fuel injection becomes zero and no change will be observed within the range of linearity. This characteristic can be readily realized by a suitable determination of the configurations of helix leads 18 and 19.

Since the fuel injection pump 1 shown in FIG. 1 has such a characteristic as mentioned above, even if the position of the second rack 3 is moved by the distance x' in order to adjust the injection timing as shown in FIG. 6, it follows that the first rack 2 is moved by y' (=2x') in the same direction in accordance therewith, and no change in the amount of fuel injection occurs, although the timing of the beginning of fuel injection changes.

As appreciated from the foregoing description, the amount of fuel injection changes only in the case where the first rack 2 changes its position due to the movement of the operating rod 31 of the governor 29. Accordingly, the position of the operating rod 31 indicates the amount of fuel injection, i.e. the magnitude of the load. For this reason, the magnitude of the load can be indicated from the position of movement of the operating rod 31 in a manner similar to that of prior art, regardless of the operation of the second rack 3, simply by the provision of an indicating means comprised of a link mechanism coupled with the operating rod 31.

Furthermore, in the foregoing embodiment, a specific case where a=b has been described, however, it is possible to compensate for the decrement or increment in the amount of fuel injection due to the movement of the second rack 3 by the movement of the first rack 2 at that time in a way similar to that described above if the inclinations of the curves A and B shown in FIG. 7 are suitably set in accordance with the ratio of a:b even if the ratio of a:b is arbitrary selected.

Figure 8:
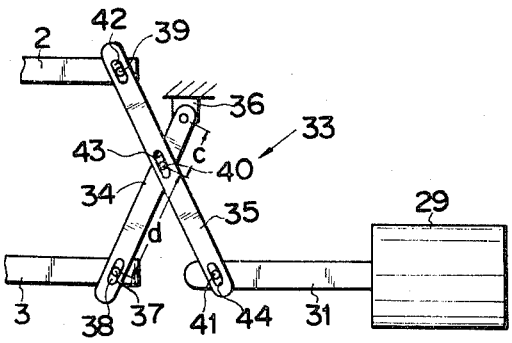
FIG. 8 is a segmentary view of another embodiment of the fuel injection pump of the present invention.

FIG. 8 shows the main portion of another embodiment according to the present invention. In this embodiment, a link mechanism 33 for operatively connecting the first and second racks 2 and 3 with the operating rod 31 has an oscillating arm 34 and an linkage arm 35. One end portion of the oscillating arm 34 is pivotally supported at a fulculum 36 and the pin 37 secured to the right end portion of the second rack 3 is engaged into an elongated hole 38 of the arm 34 to link the rack 3 with the oscillating arm 34. Pins 39, 40 and 41 are provided on the first rack 2, the oscillating arm 34 and the operating rod 31, respectively. These pins 39, 40 and 41 are respectively engaged with corresponding holes 42, 43 and 44 provided in the linkage arm 35. The intersection point of the linkage arm 35 and the oscillating arm 34 is selected as being the center between the elongated holes 42 and 44 and accordingly the first rack 2 can be similarly position-controlled by the governor 29 as in the case of FIG. 1. On the other hand, since the second rack 3 is linked with the linkage arm 35 through the oscillating arm 34, the first rack 2 is moved a predetermined distance determined by the ratio of c:d by the movement of the second rack 3, when, in the embodiment of FIG. 8, c is the distance between the intersection point of the arms 34 and 35 and the pivotally supported point of the arm 34 and d is the distance between the foresaid intersection point and the intersection point between the arm 34 and the second rack 3. Also in the embodiment of FIG. 8, as in the foregoing embodiment, both the increment and decrement in the amount of the injection caused by the movement of the second rack 3 can be reduced to zero by the movement of the first rack 2, so that the injection amount is not effected by the adjustment of the injection advance. In the mechanism shown in FIG. 8, the governor 29 may be provided on the second rack 3 side.

Figure 9:
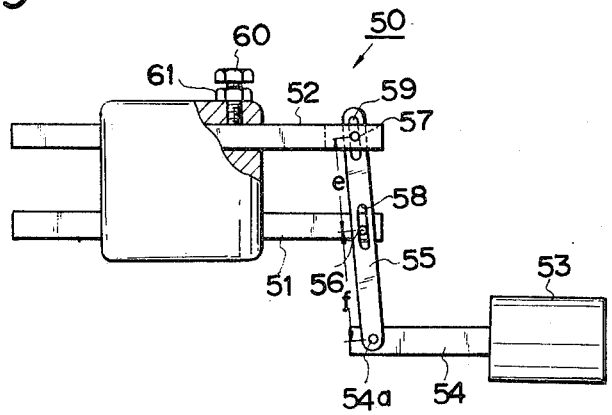
FIG. 9 is a plan view, partially broken away to show the interior construction, of a further embodiment of the fuel injection pump of the present invention.
Figure 10:
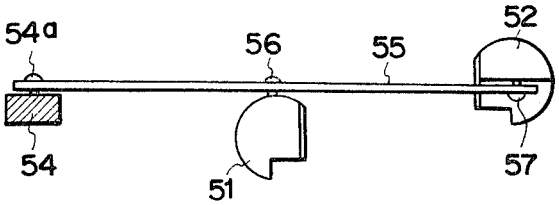
FIG. 10 is a semi-diagrammatical side view seen from the righthand side of the fuel injection pump in FIG. 9.

In FIGS. 9 and 10, there is shown still another embodiment of the present invention. A fuel injection pump 50 has a first rack 51 and a second rack 52 which correspond to the first and second racks 2 and 3 of FIG. 1. The structure of the body of the fuel injection pump 50 is the same as that of the embodiment of FIG. 1, so that the timing of the beginning of the fuel injection and the timing of the end of fuel injection can be adjusted by the adjustment of the positions of these racks 51 and 52. The reference numeral 53 denotes a governor having an operating rod 54, the free end of which is pivotally connected with one end (the lower end) of a connecting rod 55 by a connecting pin **54*a*. Connecting pins 56 and 57 are secured to the ends on one side (the right side) of the racks 51 and 52 and these connecting pins 56 and 57 are engaged with corresponding elongated holes 58 and 59 in the connecting rod 55. Thus, the racks 51 and 52 are rotatably connected with the connecting rod 59. The distance e between the pins 56 and 57 and the distance f between the pins 56 and 54*a* are basically determined in a similar way to the case of the embodiment of FIG. 1. That is, the ratio e of f should be selected in such a manner that, when the change in the timing of the beginning of fuel injection is caused by positional adjustment of the rack 52, the change in the amount of fuel injection effected by positional adjustment of the rack 52 is offset by the displacement of the rack 51 caused by the positional adjustment of the rack 52. In the determination of this ratio, the configurations of the helix leads 18 and 19 (see FIG. 2**) is to be considered.

For the second rack 52, there is provided a clamping bolt 60 threadedly mounted on the body of the fuel injection pump 50 as a clamping device, and the clamping bolt 60 is screwed thereinto after the positional adjustment of the rack 52 so that the rack 52 can be fixed at any desired position. A nut 61 is used for securely fixing the clamping bolt 60.

With this arrangement, the rack 52 can be manually positioned so as to obtain the optimum injection advance in accordance with the kind and/or quality of the fuel after loosening the clamping bolt 60, for example when the kind of fuel is changed. When the rack 52 is displaced in the lefthand direction (the direction for increasing the injection advance, in this case), for example, the outer plunger 10 is rotated in the anticlockwise direction, so that the relative relationship in position between the lead 19 and the corresponding port 21 is changed to advance the timing for closing the port 21 (see FIG. 2). As a result, the timing of the beginning of fuel injection is advanced.

At the same time, in response to the displacement of the rack 52, the rack 51 is also automatically moved through the connecting rod 55 in accordance with the ratio of f/(e+f), and the inner plunger 9 also rotates anticlockwise, so that the timing of the end of fuel injection is delayed. Consequently, the amount of the fuel injection is maintained at the desired value determined by the position of the operating rod 54.

After the adjustment described above, the rack 52 is fixed at the adjusted position by the use of the clamping bolt 60 and the nut 61.

As described above, even when the timing of the beginning of fuel injection is changed by the displacement of the rack 52, the amount of fuel injected after the timing of the beginning of fuel injection has been changed can be maintained at the same amount as before the change, so long as the position of the operating rod 54 of the governor 53 is maintained in the same position. As a result, the magnitude of the load on the engine can be known from the position of the operating rod 54 irrespective of the position of the first rack 51.

I claim:

1. A fuel injection pump, comprising:

a first plunger having a first helix lead which serves to set the timing of the end of fuel injection;

a second plunger having a second helix lead which serves to set the timing of the beginning of fuel injection;

a barrel in which ports corresponding to said first and second helix leads are defined and said first and second plungers are received;

a first pinion member having an engaging portion which is engaged with said first plunger so as to allow said first plunger to reciprocate in its axial direction and to move together with said first pinion member in its circumferential direction;

a second pinion member having an engaging portion which is engaged with said second plunger so as to allow said second plunger to reciprocate in its axial direction and to move together with said second pinion member in its circumferential direction;

a first rack for adjusting the rotational position of said first plunger to set the timing of the end of fuel injection, said first rack being engaged with said first pinion member;

a second rack for adjusting the rotational position of said second plunger to set the timing of the beginning of fuel injection, said second rack being engaged with said second pinion member;

a governor having an operating member; and means for operatively connecting said first and second racks and said operating member in such a way that only said first rack is displaced in accordance with the movement of said operating member and only said first rack is displaced at a predetermined ratio of displacement in response to the displacement of said second rack, whereby the change in the amount of fuel injection due to the change in the position of said second rack is offset by the displacement of said first rack by said second rack through said connecting means.

2. A fuel injection pump as claimed in claim 1 wherein said connecting means is composed of a lever which is pivotally connected at an intermediate portion thereof with said second rack and is operatively connected with said operating member at one end and with said first rack at the other end.

3. A fuel injeciton pump as claimed in claim 2 wherein said first and second racks and said operating member are arranged in parallel.

4. A fuel injection pump as claimed in claims 1, 2 or 3 wherein an actuator for setting the injection advance is operatively connected with said second rack.

5. A fuel injection pump as claimed in claim 1 wherein said connecting means is composed of a lever which is pivotally connected at one end with the free end of said operating member is operatively connected at its other end with said second rack and is operatively connected at an intermediate portion thereof with said first rack.

6. A fuel injection pump as claimed in claim 5 wherein said first and second racks and said operating member are arranged in parallel.

7. A fuel injection pump as claimed in claim 6, which further comprises a means for clamping said second rack at any desired position.

8. A fuel injection pump as claimed in claim 1 wherein said connecting means has a first arm pivotally supported by a supporting member and a second arm operatively connected with said first arm, said first arm is operatively connected with said second rack and said first rack is operatively connected with said operating member through said second arm.

* * * * *